US006388235B1

(12) United States Patent
Sauter et al.

(10) Patent No.: US 6,388,235 B1
(45) Date of Patent: May 14, 2002

(54) CONVECTION COOKING APPLIANCE WITH RAPID PREHEAT SYSTEM

(75) Inventors: Kenneth E. Sauter, Ooltewah; James Coty McFarland, Cleveland, both of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/984,558

(22) Filed: Oct. 30, 2001

(51) Int. Cl.[7] ..... A21B 1/26; A21B 1/40
(52) U.S. Cl. ..... 219/400; 219/413; 219/494
(58) Field of Search ..... 219/395, 396, 219/398, 413, 494, 400; 126/21 A

(56) References Cited

U.S. PATENT DOCUMENTS 3,358,122 A 12/1967 Torrey
3,808,402 A 4/1974 Rea
4,687,908 A 8/1987 Thorne
5,534,678 A 7/1996 Bowles et al.
5,688,422 A 11/1997 Landwehr et al.
5,767,488 A 6/1998 Barger et al.

*Primary Examiner*—Joseph Pelham
(74) *Attorney, Agent, or Firm*—Diederiks & Whitelaw, PLC

(57) ABSTRACT

A rapid preheat control system, provided in a cooking appliance having a oven cavity, bake and broil elements for heating the oven cavity and a fan for developing an air flow current within the oven cavity, functions to actuate the broil element a higher percentage of time than the bake element during a preheat operation in order to decrease the required time to preheat the oven cavity for a baking operation, while specifically avoiding the need to increase the overall power rating of the cooking appliance. In one preferred embodiment, 100% of the heat emanates from the broil element, while the convection fan is operated either continuously or in a pulsating manner to quickly establish an even heat distribution in the oven cavity. In other embodiments, a portion of the preheat can come from the bake element, but simply in a much lower percentage than the broil element.

18 Claims, 1 Drawing Sheet

CONVECTION COOKING APPLIANCE WITH RAPID PREHEAT SYSTEM

BACKGROUND OF THE INVENTION

1. Field of the Invention

The present invention pertains to the art of cooking and, more particularly, to a control system for regulating bake and broil heating elements of a convection cooking appliance in a manner which reduces a required preheat time without increasing a power rating for the appliance.

2. Discussion of the Prior Art

Conventional cooking appliances generally perform cooking operations through radiant heating developed from bake and/or broil elements. Such types of cooking appliances can take various forms, mainly ranges and wall ovens. When utilizing a conventional cooking appliance, the oven is initially controlled to proceed through a preheat cycle in order to reach a desired cooking temperature. Often times, a signal is provided to a user when the preheat cycle is complete in order to indicate when the food to be cooked can be placed in the oven. In some cases, both the bake and broil elements are actuated during the preheat cycle. Even though the broil element may have a higher wattage rating, the operation of this element is still limited for heat distribution, power and other reasons.

Certain known types of cooking appliances incorporate internal fans which operate during certain cooking periods. Therefore, these known cooking appliances can perform convection cooking operations. Convection cooking is actually more prevalent in microwave and other types of ovens which do not require preheating. However, utilizing convection heating in a cooking appliance including bake and broil elements is also known.

Regardless of the existence of these known arrangements, there still exists a need in the art of cooking appliances to reduce the preheat time of an oven having bake and broil elements. However, in addressing this problem, it is considered imperative that the wattage rating not be increased due to set standards on the manufacture of such appliances, as well as accepted building codes.

SUMMARY OF THE INVENTION

The present invention is directed to a rapid preheat system and method for a convection cooking appliance. More specifically, a rapid preheat control system is provided in a cooking appliance having a oven cavity, bake and broil elements for heating the oven cavity, and a fan for developing an air flow current within the oven cavity for convection purposes. The preheat control system regulates the operation of the bake and/or broil elements, as well as the fan, in a manner which minimizes the required time to preheat the oven cavity for a cooking operation, particularly a baking operation, while specifically avoiding the need to increase the overall power rating of the cooking appliance.

Although the invention could be applied to both electric and gas cooking appliances, the most preferred embodiment of the invention takes the form of an electric range. In accordance with the invention, a control algorithm is employed to actuate the broil element a higher percentage of time, as compared to the bake element, during a preheat operation. Actually, in one preferred embodiment, 100% of the heat emanates from the broil element, while the convection fan is operated either continuously or in a pulsating manner to quickly establish an even heat distribution in the oven cavity. In other embodiments, a portion of the preheat can come from the bake element, but simply in a much lower percentage than the broil element. When utilizing the present preheat control system in a known cooking appliance programmed to perform a baking operation, it has be found that the input power could be increased up to more than 50% without resizing the circuit breaker for the appliance.

Additional objects, features and advantages of the present invention will become more readily apparent from the following detailed description of a preferred embodiment when taken in conjunction with the accompanying drawing.

DETAILED DESCRIPTION OF THE PREFERRED EMBODIMENT

Figure 1:
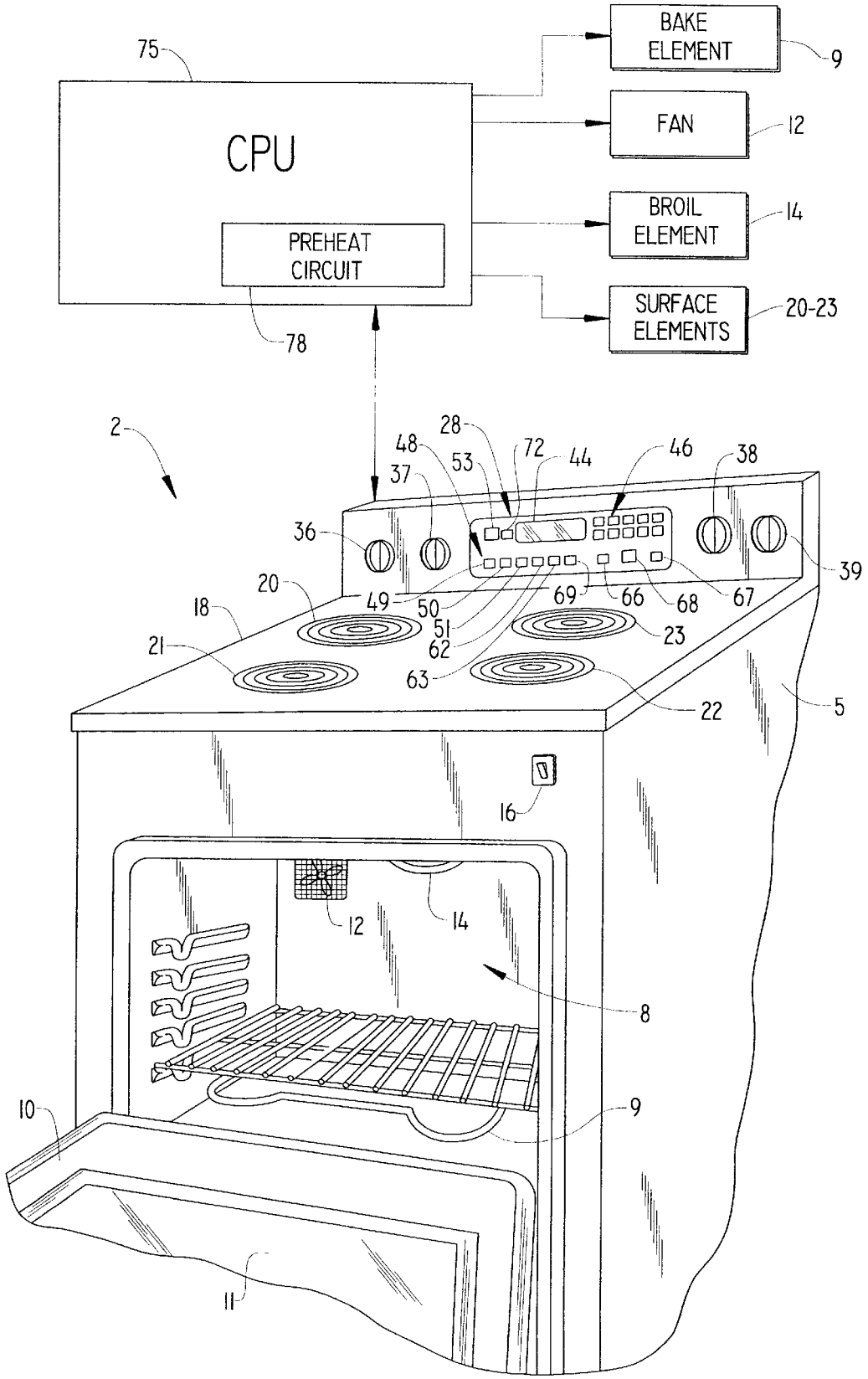
FIG. 1 is a partial perspective view of an electric range incorporating a preheat system according to the invention, including a schematic illustration of a control arrangement that forms part of the preheat system.

With initial reference to FIG. 1, the invention is illustrated for use in connection with an electric range, generally indicated at 2. In the embodiment shown, electric range 2 includes a cabinet 5 within which is arranged an oven cavity 8 having an associated lower heating element 9 and a door 10 shown in an open condition wherein access to oven cavity 8 is permitted. The following description assumes that heating element 9 is of a conventional electric heating element design, but it is considered within the scope of this invention that heating element 9 may be a gas heating element or of any other conventional design. This figure also illustrates the presence of a viewing window 11 in door 10. Furthermore, within oven cavity 8, a fan 12 and an upper, broil heating element, a part of which is shown at 14, are provided. In a manner known in the art, cabinet 5 is provided with a light switch 16 which functions to turn on a light (not shown) to illuminate oven cavity 8 upon the opening of door 10.

Cabinet 5 is also provided with an associated range top 18 which supports various spaced surface heating elements 20–23 in a manner known in the art. At an upper rear portion, cabinet 5 is provided with a control panel 28. Control panel 28 includes a plurality of knobs 36–39 for use in selectively activating and deactivating surface heating elements 20–23 respectively. In addition, control panel 28 is shown to include a central display 44, such as an LED or LCD display unit. Furthermore, control panel 28 is provided with a number pad generally indicated at 46 having buttons for the numbers zero (0) through nine (9), with the zero (0) button also functioning as a reset control button.

Although the particular features incorporated into electric range 2 could vary greatly within the scope of the present invention, for the sake of completeness in describing a preferred form of the invention, control panel 28 of range 2 is also shown to include a lower row of control buttons generally indicated at 48 which are provided to select various operational modes for range 2. For instance, the row of control buttons 48 can be used to select bake, broil and clean modes for range 2 through respective buttons 49–51. In the particular embodiment shown, an additional convection baking mode, which is essentially defined by a baking mode with the further activation of fan 12, can also be selected through button 53.

In the embodiment shown, the user may program the operation of range 2 through the use of the lower row of control buttons 48, control button 53 and numeric pad 46, as well as timer buttons 62 and 63. Furthermore, buttons 66 and 67 are provided to enable a consumer to set desired countdown and clock times, in combination with numeric pad 46, respectively. Button 68 performs a stop or clear control function, while button 69 enables a consumer to turn on the oven light without opening door 10 such that oven cavity 8 can be selectively viewed through window 11. Finally, an Auto Set button 72 is provided and can be used to perform various programming functions as will also be discussed below. Of course, although various buttons are described for use on control panel 28, other types of control switches could equally be employed.

Range 2 also incorporates an associated CPU 75, which is linked to control panel 28 for controlling fan 12 and the heat sources of range 2, i.e., at least illustrated heating elements 9, 14 and 20–23. In accordance with the present invention, CPU 75 includes a preheat circuit 78 which functions to control bake and/or broil heating elements 9 and 14, as well as fan 12, to perform an effective preheat operation for oven cavity 8 in a reduced time period as will be discussed more fully below. At this point, it should be noted that the operation of light 17 and heating elements 20–23 is performed in a manner known in the art, does not constitute part of the present invention and therefore will not be discussed further here. However, it will be mentioned that Auto Set button 72 can be used to assist the user in programming a cooking operation for range 2. For example, if bake button 49 is selected, the operating temperature can be set directly through number pad 46 or by pressing Auto Set button 72 once for a certain starting temperature, e.g. 350° F. (177° C.), and subsequently for adding a set temperature value, e.g. 25° F., upon each further depression of button 72. If a broil operation is selected through button 50, Auto Set button 72 can be used to toggle between "Hi" and "Low" settings for heating element 14. In any event, this operation is known in the art and only provided for the sake of completeness.

In using range 2, a consumer may select a desired cooking function or operational mode through control buttons 49, 50 and 53, while also establishing an operating time period for the respective heat source utilizing numeric pad 46 and timer buttons 62 and 63. Again, numeric pad 46 or Auto Set button 72 can be used to set certain operating parameters as well. In one embodiment, the selected operation will be shown by illuminating key words or symbols in central display 44. At the end of a cooking operation, it is possible to provide some type of audible or visual indicator to the consumer that the established time period has expired. This is typically done by incorporating a piezoelectric buzzer or the like. To this end, this description is similar to the structure described in U.S. Pat. No. 6,153,858, the entire disclosure of which is herein incorporated by reference.

As indicated above, the present invention is particularly directed to the manner in which CPU 75 and preheat circuit 78 function in preheating oven cavity 8 for a baking operation. Certainly, minimizing preheat time, without developing a surge of smoke from the rapid burning of cooking residual that might exist in the bottom of oven cavity 8, would be advantageous. However, in accordance with the invention, it is desirable to perform these functions by establishing control parameters which will not require a circuit breaker rating change for range 2 from a pre-established commercial standard such that range 2 of the invention can be readily employed in new residential and/or commercial developments, as well as retrofitted into existing homes or buildings.

Therefore, in accordance with the invention, a control algorithm is employed to actuate broil element 14, which has a much higher wattage rating than bake element 9 (e.g. 4000 watts versus 2585 watts), a higher percentage of time as compared to the bake element 9 during a preheat operation. In one preferred embodiment, 100% of the heat emanates from the broil element 14, while convection fan 12 is operated either continuously or in a pulsating manner to quickly establish an even heat distribution in oven cavity 8. After the preheat stage for a baking operation is completed, broil element 14 would be deactivated and baking element 9 activated, either with or without fan 12 depending on whether a baking or convection baking operation is selected by an operator.

In any event, it is desirable in accordance with the invention that broil element 14 be activated at its highest possible rating available with fan 12 operating at least in a pulsating or intermittent manner in order to efficiently minimize the preheat time within set circuit rating parameters. Of course, these parameters can vary depending on the location and field of use. However, each range 2 is produced based on a given circuit rating such that the actual operation of at least broil element 14 and fan 12 can be optimized. When utilizing the present preheat control system in this manner, it has be found that the input power can be increased up to more than 50% without resizing the circuit breaker of range 2.

Although described with reference to a preferred embodiment of the invention, it should be readily understood that various changes and/or modifications can be made to the invention without departing from the spirit thereof. For instance, although the invention has been discussed with referenced to electric range 2, it should be understood that the invention is equally applicable to gas ranges, as well both electric and gas wall ovens. In addition, although the most preferred embodiment of the invention employs only broil element 14 to develop the preheat, in other embodiments, a portion of the preheat can come from bake element 9, but simply in a much lower percentage than broil element 14. For example, when fan 12 is operated in a pulsating or intermittent manner, the lower current draw would enable bake element 9 to be operated at increasing higher levels while still staying within the required circuit breaker rating. Also, to assure the preset circuit rating is maintained in accordance with the invention, the current draw can be sensed and used to increase or decrease the heating state of broil element 14. In any event, the invention is only intended to be limited by the scope of the following claims.

What is claimed is:

1. A convection cooking appliance comprising:

an oven cavity having upper and lower portions;

a bake heating element adapted to heat the oven cavity from directly adjacent the lower portion;

a broil heating element adapted to heat the oven cavity from directly adjacent the upper portion;

a fan for developing a convective air flow within the oven cavity;

a control panel, mounted outside the oven cavity, for selecting desired cooking operations for the oven cavity, with the desired cooking operations including a baking operation; and means for controlling a preheating of the oven cavity for the baking operation, said controlling means causing the oven cavity to be preheated through activation of at least the broil heating element and the fan, with a majority of the preheating being developed by the broil heating element.

2. The cooking appliance according to claim 1, wherein said control means causes the broil element to develop substantially all of the heat for preheating of the oven cavity.

3. The cooking appliance according to claim 2, wherein the broil element is controlled to produce 100% of the heat for preheating of the oven cavity.

4. The cooking appliance according to claim 3, wherein the control means causes the fan to be continuously operated during preheating.

5. The cooking appliance according to claim 3, wherein the control means causes the fan to be pulsated during preheating.

6. The cooking appliance according to claim 2, wherein the control means further activates the bake heating element during preheating.

7. The cooking appliance according to claim 2, wherein, following preheating of the oven cavity, the control means de-activates the broil heating element for the baking operation.

8. The cooking appliance according to claim 1, wherein the control means causes the fan to be continuously operated during preheating.

9. The cooking appliance according to claim 1, wherein the control means causes the fan to be pulsated during preheating.

10. A method of preheating an oven cavity of a cooking appliance, incorporating bake and broil heating elements and a convection fan, for a baking operation comprising:

activating the broil heating element to preheat the oven cavity;

regulating the convection fan during preheating, wherein a majority of the preheating is developed by the broil heating element.

11. The method of claim 10, further comprising: causing the broil heating element to develop substantially all of the heat for preheating of the oven cavity.

12. The method of claim 11, further comprising: causing the broil heating element to produce 100% of the heat for preheating of the oven cavity.

13. The method of claim 12, further comprising: continuously operating the fan during preheating.

14. The method of claim 12, further comprising: pulsating the fan during preheating.

15. The method of claim 11, further comprising: activating the bake heating element during preheating.

16. The method of claim 11, further comprising: de-activating the broil heating element, following the preheating of the oven cavity, for the baking operation.

17. The method of claim 10, further comprising: continuously operating the fan during preheating.

18. The method of claim 10, further comprising: pulsating the fan during preheating.

* * * * *